US006773157B1

(12) United States Patent
Grau

(10) Patent No.: US 6,773,157 B1
(45) Date of Patent: Aug. 10, 2004

(54) SETTING ASSEMBLY FOR AN ANALOG TIMEPIECE

(75) Inventor: Siegfried Grau, Pforzheim (DE)

(73) Assignee: Timex Group B.V. (NL)

( * ) Notice: Subject to any disclaimer, the term of this patent is extended or adjusted under 35 U.S.C. 154(b) by 67 days.

(21) Appl. No.: 10/349,339

(22) Filed: Jan. 22, 2003

Related U.S. Application Data

(63) Continuation-in-part of application No. 10/334,025, filed on Dec. 30, 2002.

(51) Int. Cl.[7] ..... G04B 37/00; G04B 29/00

(52) U.S. Cl. ..... 368/308; 368/288; 368/306; 368/319

(58) Field of Search ..... 368/288, 306, 368/308, 319

(56) References Cited

U.S. PATENT DOCUMENTS 3,673,790 A * 7/1972 Gasser et al. ..... 368/195
3,766,730 A * 10/1973 Kishida et al. ..... 368/185
3,844,107 A * 10/1974 Guyot ..... 368/22
4,415,277 A 11/1983 Ganter
5,210,721 A * 5/1993 Kikuchi ..... 368/21

* cited by examiner

*Primary Examiner*—David Martin
*Assistant Examiner*—Michael L. Lindinger
(74) *Attorney, Agent, or Firm*—Carmody & Torrance LLP

(57) ABSTRACT

A time adjustment assembly for a timepiece comprises a fast hour wheel that is movable between a first position where it is not rotationally engageable with the hour wheel and a second position where it is rotationally engageable with the hour wheel; a corrector wheel, mounted on the setting stem, for rotating the fast hour wheel; and a setting spring selectively engageable with the fast hour wheel to move the fast hour wheel between the fast hour wheel's first position and second position; wherein when the fast hour wheel is in rotational engagement with the hour wheel the setting stem is out of engagement with the setting wheel and an hour hand is movable independently of the minute hand via the rotation of the setting stem.

8 Claims, 6 Drawing Sheets

SETTING ASSEMBLY FOR AN ANALOG TIMEPIECE

This application is a continuation-in-part of U.S. application Ser. No. 10/334,025, now pending, and claims priority to and the benefit of the filing date thereof.

BACKGROUND OF THE INVENTION

This invention relates generally to analog timepieces and more particularly, to an improved setting assembly that provides for a quick adjustment feature in which a hand or date indicator, for example, of an analog watch can be rotated independently of the motor, thereby providing a fast setting or adjustment feature particularly advantageous in streamlining adjustments to take into account a change in time zone or daylight savings time, for example. In the preferred embodiment, the setting feature is directed to the fast setting of the hour hand.

As many users/owners of analog watches know, setting or adjusting the hands on an analog watch time can be somewhat time consuming for most, and possibly frustrating for some. Timepieces have been constructed to facilitate such time setting, and are described in such patents as U.S. Pat. Nos. 5,305,291 and 5,742,565.

However, further improvements are desired. For example, it would be desirable to construct a timepiece in which the hour hand can be adjusted hour-steps independently of the minute hand, thereby facilitating the time setting of a watch, while also making the setting thereof much faster. The present invention provides just such a feature as well as the advantages afforded thereby.

SUMMARY OF THE PRESENT INVENTION

Generally speaking, it is an object to provide an improved time adjustment assembly for use in a timepiece that allows for fast setting of a hand or date, and in preferred embodiment, the fast setting of the hour hand independently of the minute hand, used for time zone setting.

It is thus another object to provide an assembly that allows for quick time setting to adjust for time zone and daylight saving changes, for example.

Still other objects and advantages of the invention will in part be obvious and will in part be apparent from the specification.

The invention accordingly comprises the features of construction, combination of elements and arrangement of parts which will be exemplified in the construction hereinafter set forth, and the scope of the invention will be indicated in the claims.

In one embodiment, the time adjustment assembly is designed for a timepiece, wherein the timepiece comprises a casing, a setting stem displaceable in a plurality of axial positions and including a toothed ring thereon, a setting wheel that is selectively and rotatably engageable with the toothed ring on the setting stem, a center wheel that is rotatably engageable with the setting wheel, a third wheel that is rotatably engageable with the center wheel, and a center gear that is rotatably engageable with the third wheel, and the time adjustment assembly comprises a fast wheel that is movable between a first position where it is not rotationally engageable with the center gear and a second position where it is rotationally engageable with the center gear; a corrector wheel, mounted on the setting stem, for rotating the fast wheel; a setting spring selectively engageable with the fast wheel to move the fast wheel between the fast wheel's first position and second position; wherein when the fast wheel is in rotational engagement with the center gear the setting stem is out of engagement with the setting wheel and an selected hand is independently movable via the rotation of the setting stem.

In a particular and preferred embodiment, the time adjustment assembly comprises a fast hour wheel that is movable between a first position where it is not rotationally engageable with the hour wheel and a second position where it is rotationally engageable with the hour wheel; a corrector wheel, mounted on the setting stem, for rotating the fast hour wheel; and a setting spring selectively engageable with the fast hour wheel to move the fast hour wheel between the fast hour wheel's first position and second position; wherein when the fast hour wheel is in rotational engagement with the hour wheel the setting stem is out of engagement with the setting wheel and an hour hand is movable independently of the minute hand via the rotation of the setting stem.

BRIEF DESCRIPTION OF THE DRAWINGS

The above set forth and-other features of the invention are made more apparent in the ensuing Detailed Description of the Preferred Embodiments when read in conjunction with the attached Drawings, wherein.

Identically labeled elements appearing in different ones of the above-described figures refer to the same elements but may not be referenced in the description for all figures.

DETAILED DESCRIPTION OF THE PREFERRED EMBODIMENTS

Prior to making specific reference to the Figures, it should be understood that what has been omitted herein are certain basic and very well known concepts as to the construction and function of an analog or chronograph watch. Accordingly, reference shall be made to the important and material features of the present invention, it being assumed that one skilled in the art would be well able to construct the basic and underlying analog watch without reference having to be made to the present specification. By way of background, one may wish to review U.S. Pat. Nos. 5,305,291, 5,742,565, 5,446,703, the subject matter of all these patents being incorporated by references as if fully set forth herein.

Turning now to the features and construction that make up the present invention, the Figures most clearly illustrates a timepiece generally indicated at 10, which itself includes a casing 12 and a frame assembly 13. A setting stem generally indicated at 20, details of which will be disclosed below, is shown to extend from casing 12 sufficiently to allow for manual manipulation by a user, preferably via a crown 22 coupled to the end of setting stem 20.

Figure 1:
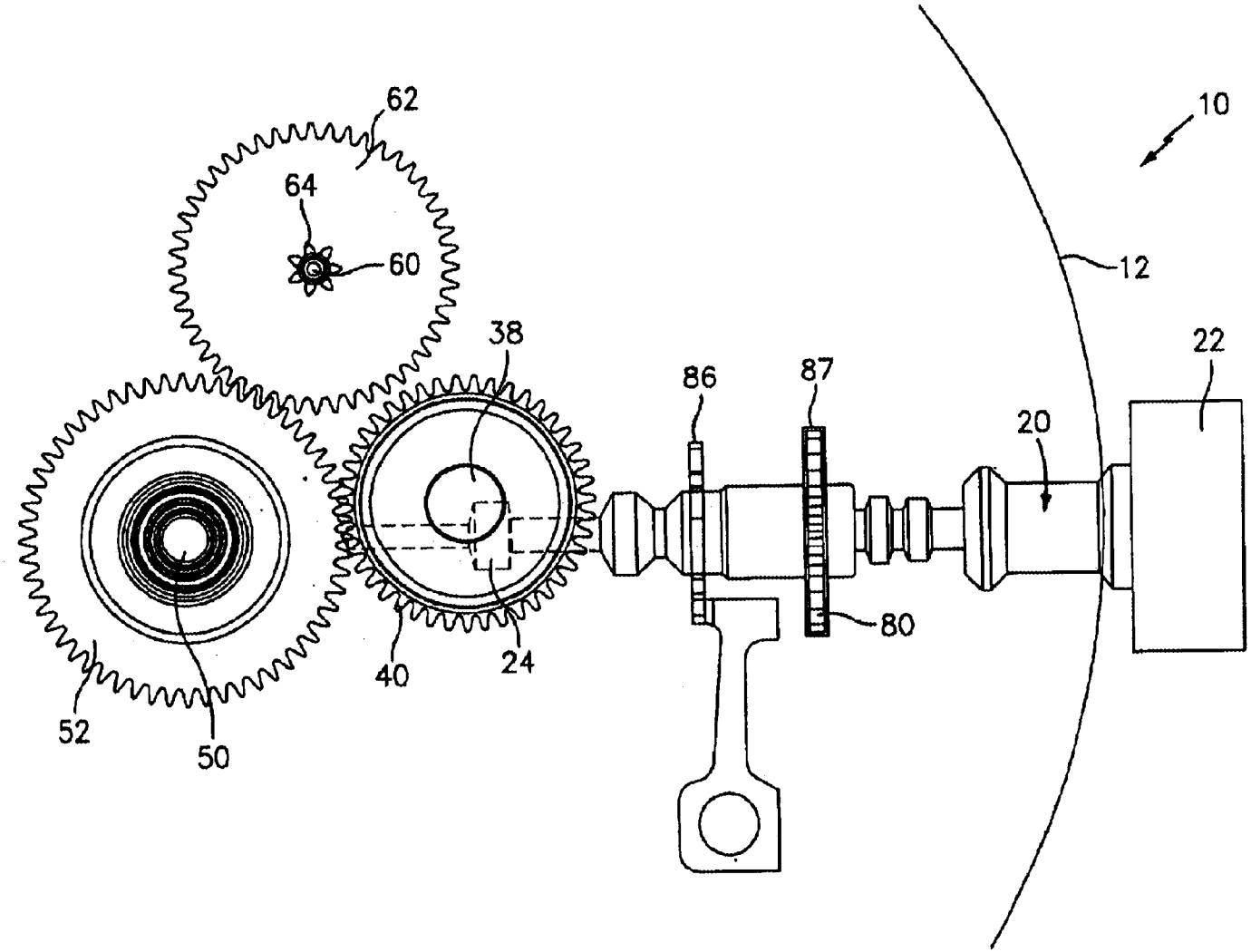
FIG. 1 is a top plan view of a timepiece constructed in accordance with the present invention, showing only certain material elements thereof.
Figure 2:
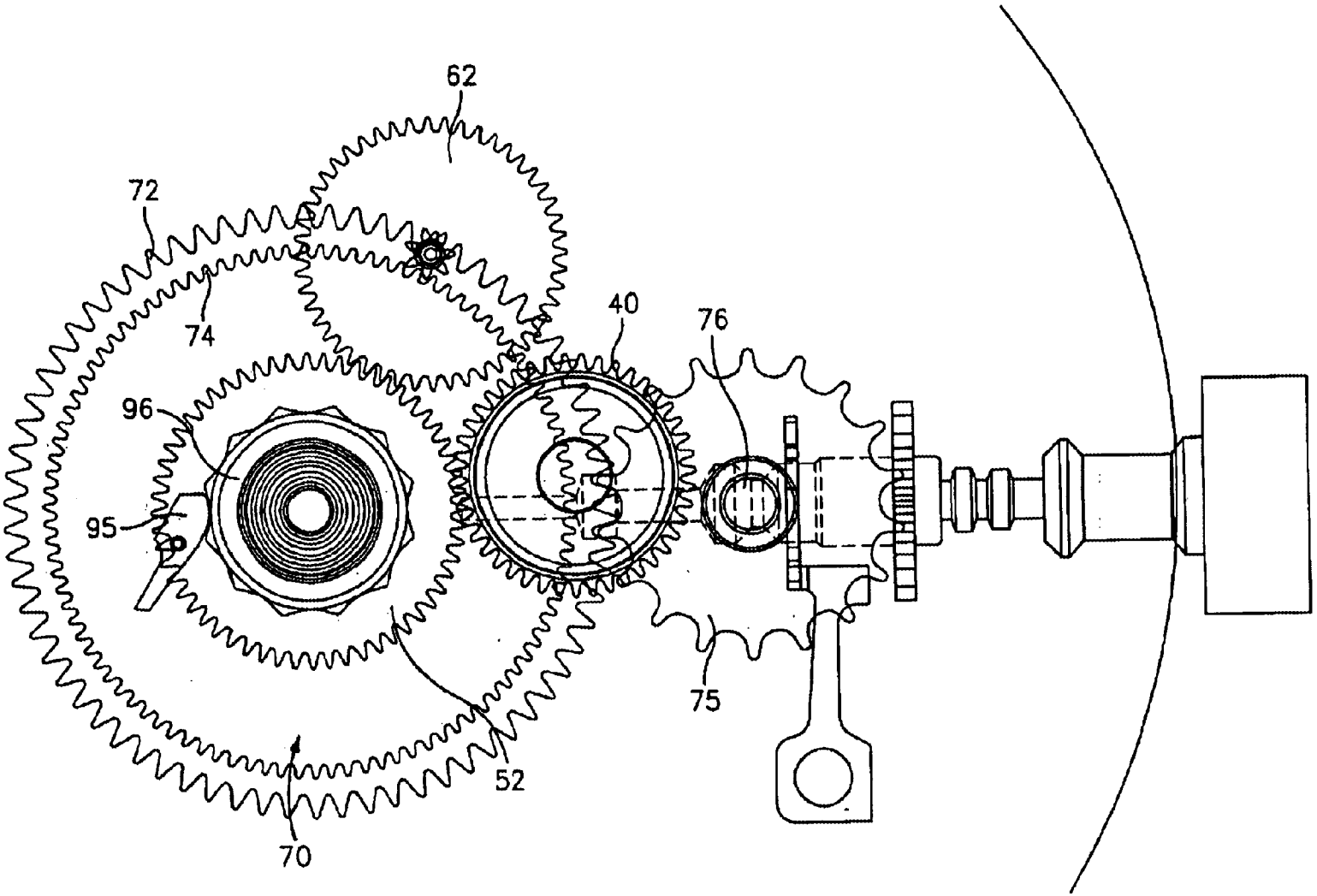
FIG. 2 is a top plan view of a timepiece constructed in accordance with the present invention, showing certain other material elements thereof.
Figure 3:
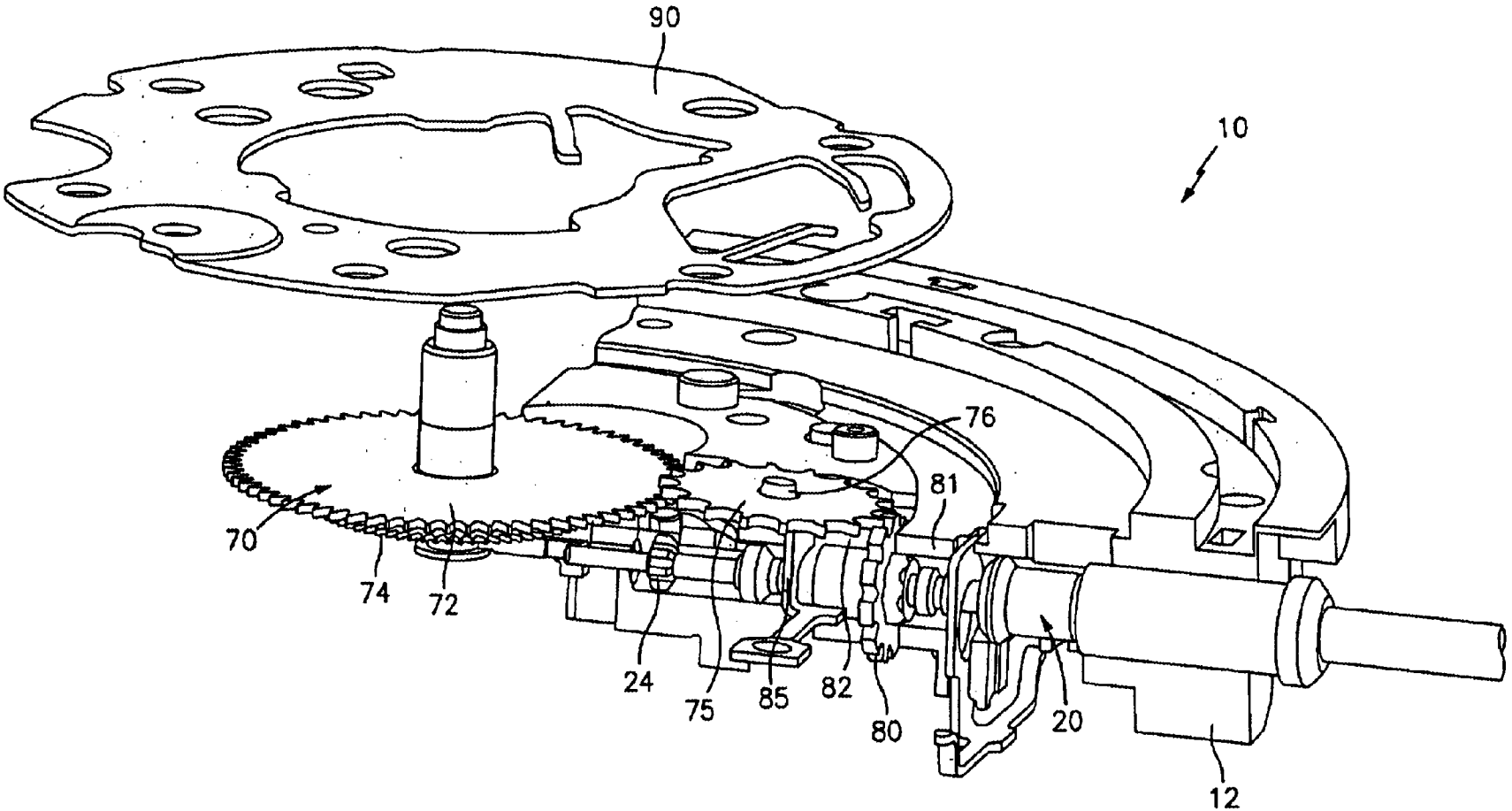
FIG. 3 is a perspective view of a timepiece constructed in accordance with the present invention, showing yet further features of the present invention, again, omitting features and elements not material to the present invention.

Setting stem 20 is displaceable in a plurality of axial positions, which will become more apparent below. In the interim, one can readily see that setting stem 20 includes a toothed wheel 24 thereon. A setting wheel 40 mounted on a stem 38, is rotatably engageable with toothed wheel 24, preferably via an orthogonally oriented meshing gear on the underside of setting wheel 40 all of which is known in the art. A center wheel 52, which can be seen to be mounted on a stem 50, is rotatably engageable via a meshing relationship with setting wheel 40. In turn, a minute wheel 62, which can be seen to be mounted on a stem 60, is rotatably engageable via a meshing relationship with center wheel 52. A smaller pinion 64 on minute wheel 62 is rotatably engageable via a meshing relationship with an hour wheel 70, which itself is also mounted on center stem 50. More specifically, FIG. 3 most clearly illustrates that hour wheel 70 has two sprockets, an upper sprocket 72 and an under sprocket 74, with under sprocket 74 being the one that meshes with pinion 64, as illustrated in FIG. 2, and the function of upper sprocket 72 being further disclosed below.

The time adjustment assembly that makes up the present invention also includes a fast hour wheel 75 which is mounted on a stem 76. Fast hour wheel 75 is tiltingly movable between a first position (FIGS. 3, 4 and 4A) where it is not rotationally engageable with upper sprocket 72 of hour wheel 70 and a second position (FIGS. 5 and 5A) where it is rotationally engageable with upper sprocket 72 of hour wheel 70.

Inducing the rotation of the fast hour wheel 75 is a corrector wheel 80, which is orthogonally aligned and rotationally, via meshing gears, coupled thereto. Corrector wheel 80 extends outwardly through a slot 87 in casing 12. Corrector wheel 80 is slidably mounted on setting stem 20. Preferably, corrector wheel 80 is wedged between two walls 81, 82, so that corrector wheel 80 cannot move in the axial direction even if setting stem 20 is displaced in the axial direction. In this way, corrector wheel 80 is always in a meshing engagement with fast hour wheel 75.

Figure 4:
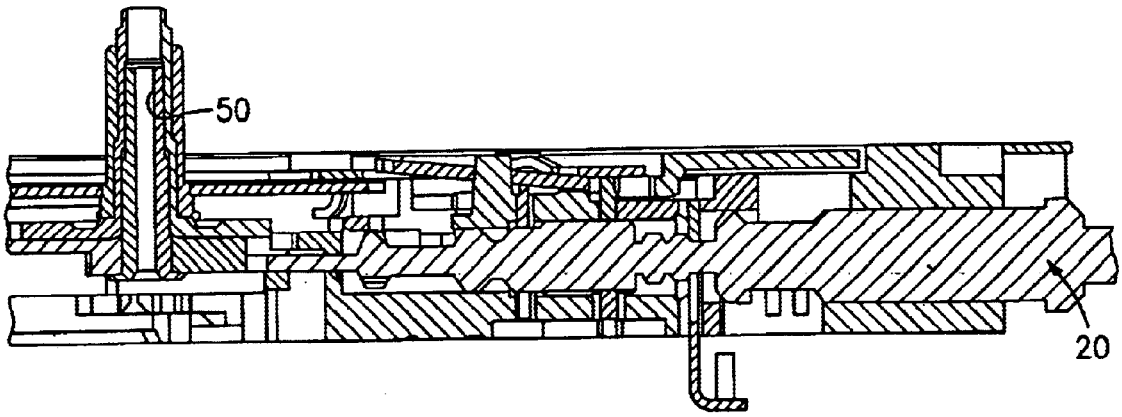
FIGS. 4, 4A and 4B are cross-sections of a timepiece constructed in accordance with the present invention, in particular, illustrating the novel fast hour wheel out of meshing engagement with the hour wheel.
Figure 4A:
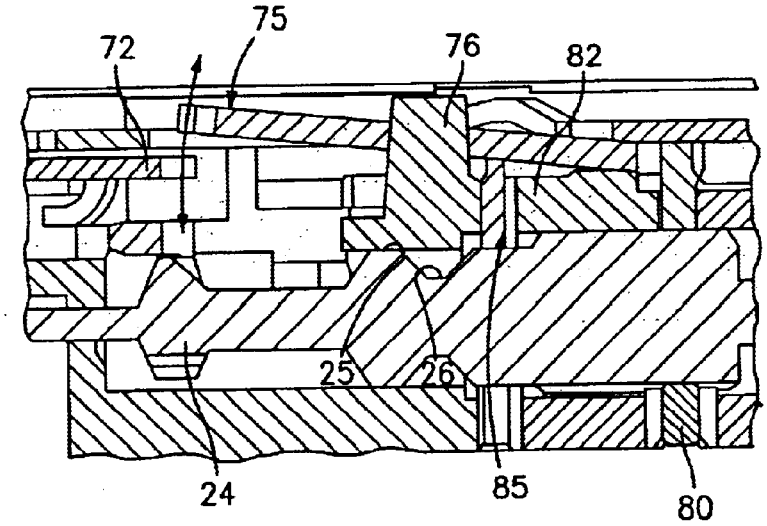
Figure 4B:
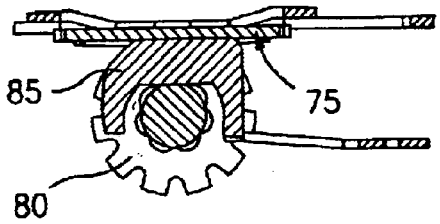
Figure 5:
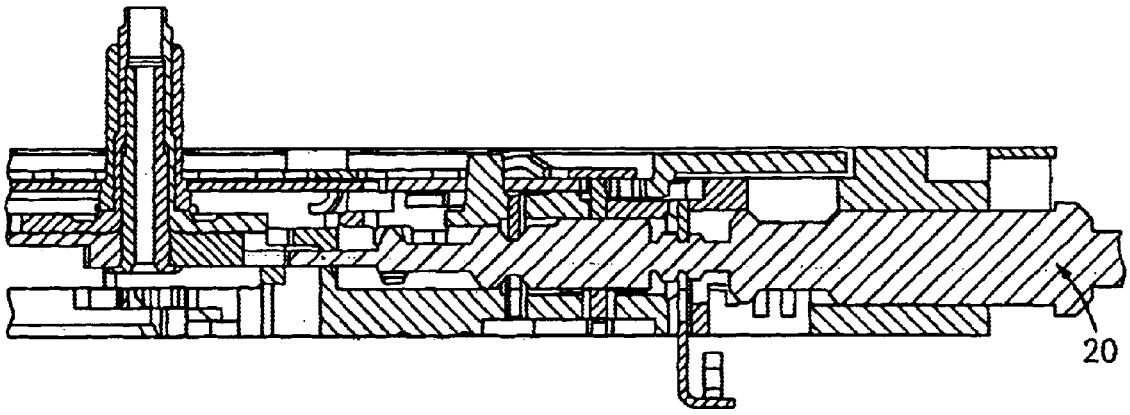
FIGS. 5, 5A and 5B are cross-sections of a timepiece constructed in accordance with the present invention, in particular, illustrating the novel fast hour wheel in meshing engagement with the hour wheel.
Figure 5A:
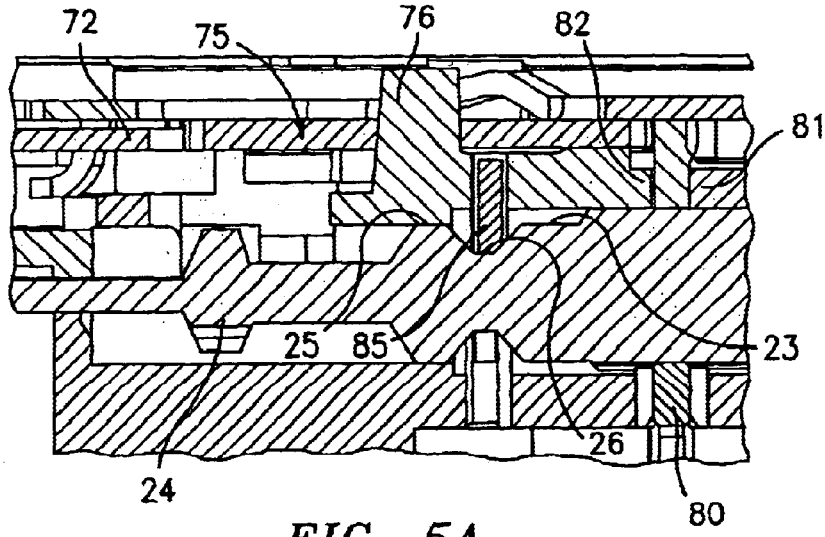
Figure 5B:
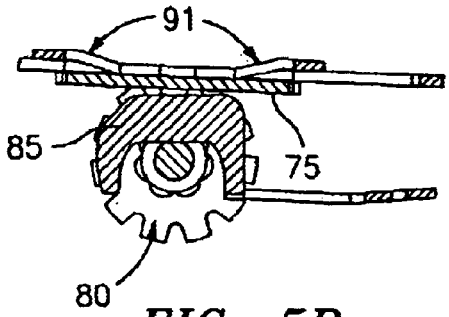

The Figures also illustrate a setting spring 85 that is selectively engageable with fast hour wheel 75 to move it between its first position (FIGS. 4 and 4A) and second position (FIGS. 5 and 5A). Setting spring 85 extends through a slot 86 in casing 12 so as to contact fast hour wheel 75.

As shown most clearly in FIGS. 4, 4A, 5 and 5A, setting stem 20 is comprised of an elongated member having a first peak region 23, a second peak region 25 and a valley region 26 intermediate the first and second peak regions. Setting spring 85 is vertically moveable between the first and second peak regions and the valley region by virtue of it being slidable along setting stem 20 and wedged between two elements, namely the other edge surface of wall 82 and an edge surface of stem 76. In this way, when setting stem is in a first axial position, for example, the normal "run" position, setting spring 85 is sitting on the first peak region 23 and causing fast hour wheel 75 to be tilted upwardly and out of meshing alignment with upper sprocket 72 of hour wheel 70 (FIGS. 4 and 4A). In a similar manner, in yet a second axial position, such as a "normal" time setting position (which happens in the preferred embodiment to be two axial positions away from the normal "run" position, as will become clear in a moment), setting spring 85 is similarly on second peak region 25 (not shown), also thereby also causing fast hour wheel 75 to be tilted upwardly and out of meshing alignment with upper sprocket 72 of hour wheel 70.

However, when setting stem 20 is in yet a third axial position (FIGS. 5 and 5A) which is the axial position between the aforementioned first two positions detailed above, it can be seen that setting spring 85 drops into valley region 26 of setting stem 20. In turn, fast hour wheel 75 likewise moves to its second position in which it meshingly aligns with the upper sprocket 72 of hour wheel 70. Moreover, in the event that the teeth of fast hour wheel 75 are not immediately in meshing alignment with the teeth of upper sprocket 72 (that is, they are actually aligned on top of each other), it should be understood that the initial rotation of fast hour wheel 75 via the setting stem 20 will allow the proper alignment so that fast hour wheel 75 can properly drop into meshing alignment with sprocket 72. Fingers 91 on a holding plate 90 provide the urging force on fast hour wheel 75 downwardly into its second position when setting spring 85 slides into its position in the valley region 26 of setting stem 20. For convenience, this position in which fast hour wheel 75 is in engagement with hour wheel 70 shall be coined the "fast hour" setting position.

It can thus be seen from the foregoing description taken in conjunction with the Figures that hour wheel 70 can be selectively engaged by fast hour wheel 75, depending on the axial position of setting stem 20.

It is believed that the operation of timepiece 10 in it normal "run" and normal "time setting" modes is well known, but for completeness, the following is set forth.

Figure 6:
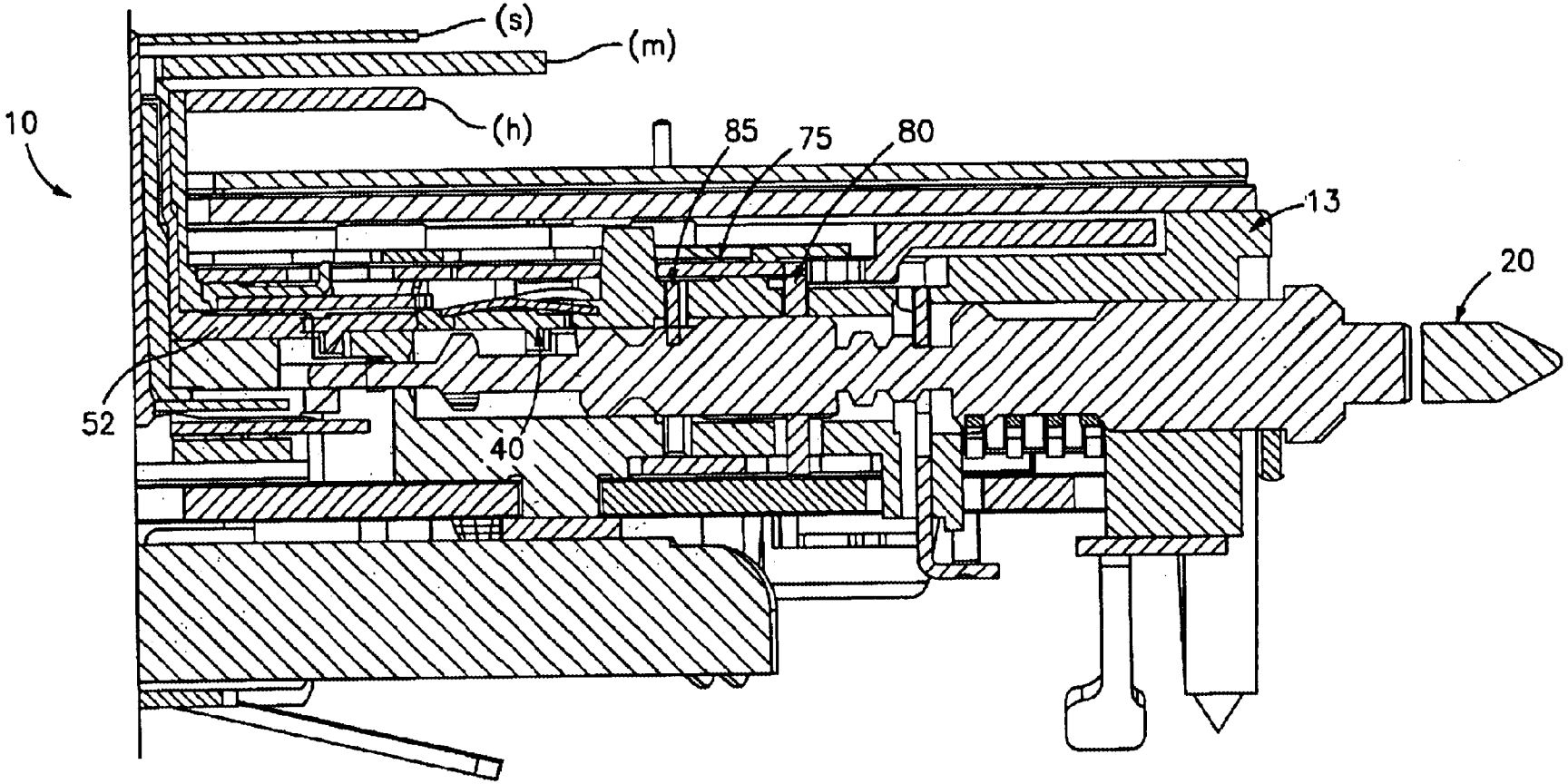
FIG. 6 is a cross-sectional view of a timepiece incorporating the present invention, showing yet other elements thereof.

Clearly, in the normal "run" position and "fast hour" setting positions, toothed wheel 24 needs to be out of meshing engagement with setting wheel 40. The cross sectional views most clearly shown by FIG. 6 illustrate the spacing within which toothed wheel 24 can slide in the axial direction without coming into meshing engagement with setting wheel 40. Rather, it is only when setting stem 20 is in its second pulled axial position (wherein setting spring 85 is on second peak region 25 and fast hour wheel 75 will be out of meshing alignment with hour wheel 70) that toothed wheel 24 can meshingly engage with setting wheel 40. In this position, the setting stem and gear train cause the hour and minute hands to rotate, all of which is well know in the art.

While the invention has been particularly shown and described with respect to preferred embodiments thereof, it will be understood by those skilled in the art that changes in form and details may be made therein without departing from the scope and spirit of the invention.

For example, the present invention has been disclosed above with particular reference to timepieces. However, one skilled in the art shall now appreciate that the present invention is equally applicable, and as claimed herein, to devices other than timepieces, such as, but not limited to clocks. Also, the terms "meshingly" rotationally, etc. should all be understood to be interchangeable, and merely a convenient way to disclose the engagement between the gears/wheels, all of which should be understood by one skilled in the art.

Lastly, the feature whereby the hour hand can accurately "drop into" each of the next hour locations is known in the art, and is shown generically to be achieved by the use of a detent spring 95 that engages indentations on a sprocket shown generically at 96 and located on an upperside of hour wheel 70, although clearly, this sprocket 96 can be positioned on the underside of wheel 70 as well. In this way, when one desires to advance the time by one hour, a user need not worry that he/she has only advanced the hour hand, for example, 55 minutes, since the invention incorporates by reference the ability for the second hand to be accurately placed, as seen in FIG. 2 by the use of spring 95 and sprocket 96 which causes the hour wheel 70 to "drop into" place. It should be well understood however, that this is an oversimplification of this feature since the spring and sprocket combination needs to be able to provide for the ability of the hour hand to change positions no matter where during the hour the hand is positioned, but as this is well known by those skilled in the art, no further disclosure is deemed to be needed thereby.

FIG. 6 can be seen to illustrate second hand (s), minute hand (m) and hour hand (h). While the construction and mounting of such hands should be routine for one skilled in the art, for completeness it is noted that the hour hand (h) is coupled to the hour wheel 70 (or center gear) so that the rotation of hour wheel 70 by the fast hour wheel 75 allows and/or causes the rotation or otherwise movement of the hour hand independently of the minute hand.

It can thus be seen that the present invention provides a unique and advantageous way to adjust the hour hand on a timepiece independently of the minute hand, thus making such setting or adjustment both quicker and easier.

However, one skilled in the art would well appreciate that the present invention is broadly applicable to adjustments other than only the hour hand. As such, the specification should be understood to be so broadly construed. Specifically, the fast hour wheel 75 should first be understood to encompass any wheel to which is coupled, via a center wheel for example, a hand for displaying information. Similarly, hour wheel 70 should be understood to thus be broadly construed as a center gear, with "gear" and "wheel" being understood to be interchangeable terms. The claims should be so broadly construed. In this way, the claims and specification arc enabled to cover a range of applications.

Moreover, as the present invention uniquely uses a "drop in" wheel such as wheel 75, other configurations and applications utilizing the present invention can also be achieved. For example, a simple reorganization of the meshing relationships between the wheels, or a reconfiguration of the wheels themselves can provide for the ability to quickly adjust the date indicator, such as a date ring. It is envisioned that this can be done independently of the hour hand, although it should be appreciated that the date ring in the present invention can get quickly adjusted taking into account the fact that the date ring is rotatably coupled to the hour wheel, as would be well appreciated in a conventional analog watch. Therefore, the present invention should be understood to be broadly applicable to a wide range of implementations, since the arrangement of wheels could permit the date ring to independently rotate quickly by use of a fast wheel set similar to that disclosed by fast wheel 75, as long as the wheels are configured and arranged therefore.

What is claimed is:

1. A time adjustment assembly for a timepiece, wherein the timepiece comprises a casing, a setting stem displaceable in a plurality of axial positions and including a toothed ring thereon, a setting wheel that is selectively and rotatably engageable with the toothed ring on the setting stem, a center wheel that is rotatably engageable with the setting wheel, a minute wheel that is rotatably engageable with the center wheel, and an hour wheel that is rotatably engageable with the minute wheel, the time adjustment assembly comprising:

a fast hour wheel that is movable between a first position where it is not rotationally engageable with the hour wheel and a second position where it is rotationally engageable with the hour wheel;

a corrector wheel, mounted on the setting stem, for rotating the fast hour wheel;

a setting spring selectively engageable with the fast hour wheel to move the fast hour wheel between the fast hour wheel's first position and second position;

wherein when the fast hour wheel is in rotational engagement with the hour wheel the setting stem is out of engagement with the setting wheel and an hour hand, which is coupled to the hour wheel, is movable independently of the minute hand via the rotation of the setting stem.

2. The time adjustment assembly as claimed in claim 1, wherein the setting stem comprises a first peak region, a second peak region and a valley region intermediate the first and second peak regions, wherein the setting spring is moveable between the first and second peak regions and the valley region;

wherein when the setting spring is on the first or the second peak regions, the fast hour wheel is in its first position, and wherein when the setting stem is in the valley region of the setting stem, the fast hour wheel is in its second position.

3. The assembly as claimed in claim 1, wherein:

when the setting stem is in a first axial position:

the setting stem is not engaged with the setting wheel; and the setting spring is on the first peak region and the fast hour wheel is not engaged with the hour wheel;

when the setting stem is in a second axial position:

the setting stem is not engaged with the setting wheel; and the setting spring is in the valley region and the fast hour wheel is engaged with the hour wheel; and when the setting stem is in a third axial position:

the setting stem is engaged with the setting wheel; and the setting spring is on the second peak region and the fast hour wheel is not engaged with the hour wheel.

4. The assembly as claimed in claim 1, wherein the hour wheel is comprised of an upper and a lower sprocket and wherein the lower sprocket rotatably engages the minute wheel; and wherein the fast hour wheel rotatably engages the upper sprocket of the hour wheel when the fast hour wheel is in its second position.

5. The assembly as claimed in claim 1, including an hour hand coupled to the hour wheel.

6. A wristwatch comprising:

a casing, a setting stem displaceable in a plurality of axial positions and including a toothed ring thereon, a setting wheel that is selectively and rotatably engageable with the toothed ring on the setting stem, a center wheel that is rotatably engageable with the setting wheel, a minute wheel that is rotatably engageable with the center wheel, and an hour wheel that is rotatably engageable with the minute wheel, and a time adjustment assembly comprising:

a fast hour wheel that is movable between a first position where it is not rotationally engageable with the hour wheel and a second position where it is rotationally engageable with the hour wheel;

a corrector wheel, mounted on the setting stem, for rotating the fast hour wheel;

a setting spring selectively engageable with the fast hour wheel to move the fast hour wheel between the fast hour wheel's first position and second position;

wherein when the fast hour wheel is in rotational engagement with the hour wheel the setting stem is out of engagement with the setting wheel and an hour hand, which is coupled to the hour wheel, is movable independently of the minute hand via the rotation of the setting stem.

7. A time adjustment assembly for a timepiece, wherein the timepiece comprises a casing, a setting stem displaceable in a plurality of axial positions and including a toothed ring thereon, a setting wheel that is selectively and rotatably engageable with the toothed ring on the setting stem, a center wheel that is rotatably engageable with the setting wheel, a third wheel that is rotatably engageable with the center wheel, and a center gear that is rotatably engageable with the third wheel, the time adjustment assembly comprising:

a fast wheel that is movable between a first position where it is not rotationally engageable with the center gear and a second position where it is rotationally engageable with the center gear;

a corrector wheel, mounted on the setting stem, for rotating the fast wheel;

a setting spring selectively engageable with the fast wheel to move the fast wheel between the fast wheel's first position and second position;

wherein when the fast wheel is in rotational engagement with the center gear the setting stem is out of engagement with the setting wheel and a selected hand, which is coupled to the center gear, is independently movable via the rotation of the setting stem.

8. The assembly as claimed in claim 7, wherein the third wheel is the minute wheel and the center gear is the hour wheel.

* * * * *